US008136938B2

(12) United States Patent
Karszes et al.

(10) Patent No.: US 8,136,938 B2
(45) Date of Patent: Mar. 20, 2012

(54) SYSTEM AND METHOD FOR PRINTING ON LENTICULAR SHEETS

(76) Inventors: William Karszes, Hilton Head, SC (US); Jerry Nims, Sandy Springs, GA (US)

( * ) Notice: Subject to any disclaimer, the term of this patent is extended or adjusted under 35 U.S.C. 154(b) by 261 days.

(21) Appl. No.: 12/468,497

(22) Filed: May 19, 2009

(65) Prior Publication Data

US 2010/0295915 A1 Nov. 25, 2010

(51) Int. Cl.
*B41J 2/01* (2006.01)
*B41J 29/38* (2006.01)
*B41J 29/393* (2006.01)

(52) U.S. Cl. ..... 347/105; 347/101; 347/16; 347/19

(58) Field of Classification Search ..... None
See application file for complete search history.

(56) References Cited

U.S. PATENT DOCUMENTS 5,479,270 A * 12/1995 Taylor ..... 358/488
5,500,712 A * 3/1996 Miyawaki et al. ..... 355/22
5,757,400 A 5/1998 Hoisington
5,812,152 A 9/1998 Torigoe et al.
6,087,054 A * 7/2000 Cobb et al. ..... 430/30
6,154,247 A * 11/2000 Marino et al. ..... 347/256
6,177,217 B1 * 1/2001 Agostinelli et al. ..... 430/22
6,195,150 B1 * 2/2001 Silverbrook ..... 355/22
6,249,384 B1 * 6/2001 Cobb et al. ..... 359/623
6,460,993 B2 10/2002 Pilu
6,709,080 B2 * 3/2004 Nims et al. ..... 347/1
7,400,451 B2 * 7/2008 Robb et al. ..... 359/619
2001/0048458 A1 * 12/2001 Pilu ..... 347/107
2002/0167679 A1 11/2002 Nims et al.
2003/0016370 A1 * 1/2003 Goggins ..... 358/1.2
2005/0152729 A1 7/2005 Goggins
2006/0066879 A1 3/2006 Bast et al.
2007/0196153 A1 * 8/2007 Bar Yona ..... 400/62
2007/0206084 A1 * 9/2007 Suzuki et al. ..... 347/105
2007/0248774 A1 10/2007 Suzuki et al.

* cited by examiner

*Primary Examiner* — Stephen Meier
*Assistant Examiner* — Leonard S Liang
(74) *Attorney, Agent, or Firm* — Patton Boggs LLP

(57) ABSTRACT

A system for printing on lenticular sheets, including a printer having a lenticular sheet feed tray for holding at least one lenticular sheet having a plurality of lenticules; a laterally reciprocating lenticular sheet sensor flushly disposed on the lenticular sheet feed tray for sensing parameters of the plurality of lenticules; a computing system in communication with the printer and the laterally reciprocating lenticular sheet sensor and configured to execute software modules for adapting an interphased graphical image to the parameters and printing the adapted interphased graphical image on the at least one lenticular sheet. Methods for printing on lenticular sheet and electronic systems for printing on lenticular sheet are also included.

23 Claims, 11 Drawing Sheets

SYSTEM AND METHOD FOR PRINTING ON LENTICULAR SHEETS

BACKGROUND

Without limiting the scope of the invention, its background will be described in relation to a system and method for printing on lenticular sheets, as an example.

The use of lenticular sheets to transmit images to appear to an observer as three-dimensional, and to appear different from different viewer positions, to give a perception of changing as the observer moves, is known. A summary of certain typical features, and some general examples, are given for convenience.

Lenticular sheets, as they are generally known, include a plurality of semi-cylindrical lenses, or lenticules, arranged side-by-side, in a plane, each extending in the same direction. The lenticular sheets are typically formed of a substantially transparent plastic and are overlaid onto an ink-supporting substrate or medium on which a plurality of specially formatted images are disposed.

Lenticular sheets, though, permits display of an image on a hard copy surface to appear three-dimensional. One method for this displaying is to take a picture of a scene from a first location, and then move the camera a lateral distance to a second location and take a picture of the same scene. The picture taken from the first position may be called the left image and the picture taken from the second position may be called the right image. There is a parallax between the two images, due to the lateral displacement between the respective positions from which the left and right pictures were taken. The parallax is exploited by rasterizing the left and right images or pictures into, for example, sixty-four vertical strips each. The rasterizing can be done by converting the pictures into a digital pixel array and then dividing the array into sixty-four strips, typically in a vertical direction. The left and right images are disposed on a medium, typically by placing the first vertical stripe of the left image next to the first vertical stripe of the right image, and then the second vertical stripe of the left image next to the second vertical stripe of the right image. The arrangement is typically repeated so that, for example, the sixty-four vertical stripes of the left image are interspersed with sixty-four vertical stripes of the right image, in an alternating pattern.

To increase the number of viewing positions from which the observer will see a three-dimensional image, a greater number of rasterized images are created, and a correspondingly greater number of raster lines are disposed under each lenticule. For example, instead of a left eye and right eye picture taken from a single head-on view, a plurality of left/right pictures can be taken, each from a different view. Picking three views as an example, the above-described head-on view is generated as described, and then a first flank view is generated by taking a left eye picture and a right eye picture, from a position to the left and right, respectively, of a second view position. The second view position may be displaced, for example, 10 degrees left from the head-on position. Next a right flank view is generated by taking a left picture and a right picture, from a position to the left and right, respectively, of a third view position. The third view position is displaced, for this example, 10 degrees to the right of the head-on position.

Inkjet printers have been identified as a preferred apparatus for printing lines of pixels, or raster lines, for viewing through lenticular sheets. However, inkjet printers have inherent limitations as to the minimum dot size they can print, and limitations on the minimum spacing from one dot to the next. The prior art selects line widths and spacing based on trial-and-error, or to match standard or vendor-supplied lenticular sheets. Prior art lenticular sheets, however, are manufactured without particular consideration to the specific printing capabilities of the printer, or of the type of printer, that will be used to print the interleaved pixel lines, i.e., raster lines, on the medium. The spacing between the lenticules or microlenses, though, is one of the ultimate factors bearing on the width of the pixel lines, and the number and spacing of pixel lines. More particularly, if the number of pixel lines is selected which results in a line, or pixel width, or pixel-to-pixel spacing smaller than the ink-jet printer can produce the image quality will be substantially degraded. On the other hand, if the number of pixel lines is selected based on an overly conservative estimate of the printer's capabilities, the final product will have an image quality that is lower than what could have been obtained.

A further problem has been identified with using inkjet printers to print on a lenticular sheets. The problem is that, due to human error, shortcomings in the printer feed mechanism, and other causes, the orientation of the lenticular sheets when the printing operation is performed may not be correct. As a result, as the lenticular sheets progresses through the printer there will be a migration in the position of the first lenticule in the direction of the printer carriage.

Still another problem identified is that regardless of the nominal spacing between lenticules, the raster image processing associated with an inkjet printer cannot space the pixels as correctly as attainable absent use of measured data representing the lenticule spacing of the lenticule sheets that is actually being printed on.

SUMMARY

The above-described problems are solved and a technical advance is achieved by the system and method for printing on lenticular sheets ("system for printing on lenticular sheets") disclosed in this application. The system for printing on lenticular sheets may be used for printing on a variety of different lenticular sheets, for example. In one embodiment, the system for printing on lenticular sheets includes a printer having a lenticular sheet feed tray for holding at least one lenticular sheet having a plurality of lenticules; a laterally reciprocating lenticular sheet sensor flushly disposed on the lenticular sheet feed tray for sensing parameters of the plurality of lenticules; a computing system in communication with the printer and the laterally reciprocating lenticular sheet sensor and configured to execute software modules for adapting an interphased graphical image to the parameters and printing the adapted interphased graphical image on the at least one lenticular sheet.

In one aspect, the parameters are selected from the group consisting of lenses per inch, width of the plurality of lenticules, spacing of the plurality of lenticules, position of the first of the plurality of lenticules closest to a print head of the printer, and angular displacement of the lenticular sheet relative to a reference point on the printer. In another aspect, the printer has a sensitivity of from about 0.001 to about 0.009 lenses per inch. Preferably, the printer has a minimum print resolution of 600 dots per inch. Also, the printer may have a volume per ink drop of no greater than 2 picoliters. In another aspect, the computing system further includes a display in communication with the computing system for displaying to a user one or more of the parameters and the adapted interphased graphical image. Further, the laterally reciprocating lenticular sheet sensor further includes a carrier for moving the lenticular sheet sensor reciprocally laterally across the at least one lenticular sheet. Additionally, the system for printing on lenticular foil includes at least two printers and their associated print heads; and at least two lenticular sheet sensors for registering the parameters of a selected one of the at least two printers to one of a selected at least two lenticular sheet sensors.

In another embodiment, the present system for printing on lenticular foil includes a method for printing on lenticular sheets includes disposing at least one lenticular sheet having a plurality of lenticules onto a lenticular sheet feed tray of a printer having a print head, the lenticular sheet feed tray having a reciprocating lenticular sheet sensor; scanning the lenticular sheet with the reciprocating lenticular sheet sensor to determine parameters of the plurality of lenticules; selecting a graphical image; interphasing the graphical image; adapting the interphased graphical image to substantially match the parameters; and printing the adapted interphased graphical image to the lenticular sheet. In one aspect, the method further includes displaying the adapted interphased graphical image. Preferably, the parameters are selected from the group consisting of lenses per inch, width of the plurality of lenticules, spacing of the plurality of lenticules, position of the first of the plurality of lenticules closest to a print head of the printer, and angular displacement of the lenticular sheet relative to a reference point on the printer. Also preferably, scanning the lenticular sheet with the reciprocating lenticular sheet sensor further includes determining the distance between a first edge of a first of the plurality of lenticules and the print head of the printer with the reciprocating lenticular sheet sensor.

In another aspect, scanning the lenticular sheet with the reciprocating lenticular sheet sensor further includes determining the angular displacement between a first edge of the first of the plurality of lenticules and the print head of the printer with the reciprocating lenticular sheet sensor. Preferably, the scanning the lenticular sheet with the reciprocating lenticular sheet sensor further includes determining the spacing between the plurality of lenticules with the reciprocating lenticular sheet sensor. Also, scanning the lenticular sheet with the reciprocating lenticular sheet sensor further includes determining the lenses per inch of the plurality of lenticules with the reciprocating lenticular sheet sensor. In another aspect, selecting a graphical image further includes displaying a plurality of graphical images to a user for selection by the user. The method may further include registering a selected printer and associated print head with a selected lenticular sheet.

In yet another embodiment, the present system for printing on lenticular foil includes an electronic system for printing on a lenticular sheet having a plurality of lenticules including an electronic input device for producing input signals; a display; a printer having a lenticular sheet feed tray for holding the lenticular sheet, the lenticular sheet feed tray having a reciprocating lenticular sheet sensor, the printer having a print head for printing ink dots on the lenticular sheet; an electronic memory storing a list of graphical images; and an electronic processor communicating with the memory and the display and responsive to the input signals to: determine parameters of the plurality of lenticules by the reciprocating lenticular sheet sensor; accept a selection of one of the graphical images by the electronic input device; interphase the selected graphical image based on the scanned parameters of the plurality of lenticules; adapt the interphased graphical image to the graphical image based on the scanned parameters of the plurality of lenticules; and instruct the printer to print on the lenticular sheet the adapted interphased graphical image.

In one aspect, the electronic processor is further responsive to the input signals to record the distance between the first edge of a first of the plurality of lenticules and the print head of the printer with the reciprocating lenticular sheet sensor; and responsive to the recording, adapt the interphased selected graphical image with the recorded distance. In another aspect, the electronic processor is further responsive to the input signals to record the angular displacement between the first edge of a first of the plurality of lenticules and the print head of the printer with the reciprocating lenticular sheet sensor; and responsive to the recording, adapt the interphased selected graphical image with the recorded angular displacement. Preferably, the electronic processor is further responsive to the input signals to record the spacing between the plurality of lenticules with the reciprocating lenticular sheet sensor; and responsive to the recording, adapt the interphased selected graphical image with the recorded spacing. Also preferably, the electronic processor is further responsive to the input signals to record the lenses per inch of the plurality of lenticules with the reciprocating lenticular sheet sensor; and responsive to the recording, adapt the interphased selected graphical image with the recorded lenses per inch. In yet another aspect, the electronic processor is further responsive to the input signals to select one of a plurality of printers each with stored parameters with select one of a plurality of lenticular sheets each with a stored parameters for registering the two parameters prior to printing.

BRIEF DESCRIPTION OF THE DRAWINGS

For a more complete understanding of the features and advantages of the system for printing on lenticular sheets, reference is now made to the detailed description of the invention along with the accompanying figures in which corresponding numerals in the different figures refer to corresponding parts and in which.

DETAILED DESCRIPTION OF THE DRAWINGS

Figure 1:
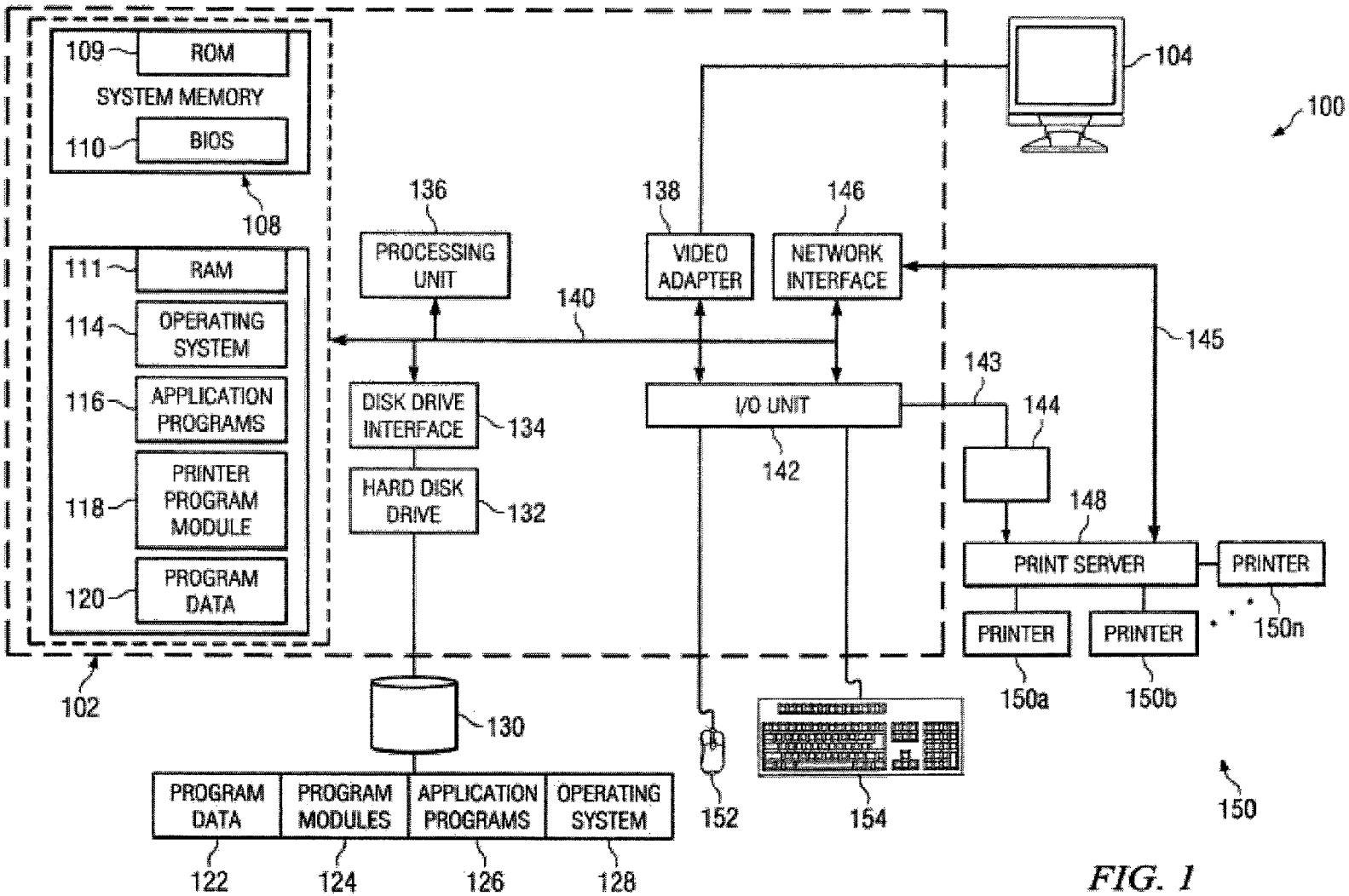
FIG. 1 is a schematic diagram generally illustrating an exemplary computer system and printer according to one embodiment.

The term "lenticular sheet" is used herein to mean any type of lenticular lens material capable of being printed on with a printer, such as micro-optical material, lenticular sheets, plastic lenticular sheet, lenticular foil, lenticular plastic sheets, lenticular plastic, and the like. Any embodiment, aspect, or design described herein as "exemplary" is not necessarily to be construed as preferred or advantageous over other embodiments, aspects, or designs. Additionally, like reference numerals refer to like elements and the system for printing on lenticular sheets is described hereinafter in the context of a particular computing environment. Although it is not required for practicing the system for printing on lenticular sheets, it is described as it is implemented by computer-executable instructions, such as program or software modules, that are executed by a computer. Generally, program modules include routines, programs, objects, components, data structures and the like that perform particular tasks or implement particular abstract data types.

To facilitate a ready understanding of the novel aspects of the present system for printing on lenticular sheets, one or more two-dimensional graphical images, graphical images, sequences of graphical images, and the like are digitized into a pixel array, and the array is segmented into strips of pixels. For purposes of this description, a strip of pixels may be referenced as a "raster line." Raster lines are interleaved or interphased, using known data manipulation methods, and output to one or more printers as further described below. The novel aspects of the present system for printing on lenticular sheets relate to the spacing between the raster lines, the structure and spacing between the lenticules of a particular lenticular sheet, measuring the spacing between lenticules after the lenticular sheet is installed in the printer, modifying the pixel spacing based on the measured spacing, and a system integrating these novel features in a further unique combination.

The system for printing on lenticular sheets may be implemented in computer system configurations other than a computer. For example, the system for printing on lenticular sheets may be realized in hand-held devices, multi-processor systems, microprocessor-based or programmable consumer electronics, network computers, minicomputers, mainframe computers and the like. The system for printing on lenticular sheets may also be practiced in distributed computing environments, where tasks are performed by remote processing devices that are linked through a communications network. In a distributed computing environment, program modules may be located in both local and remote memory storage devices.

Before describing the system for printing on lenticular sheets in detail, the computing environment in which the invention operates is described in connection with FIG. 1. FIG. 1 is a schematic diagram of an exemplary system for printing on lenticular sheets 100 including a computer 102 that includes a processing unit 136, a system memory 108, and a system bus 140 that couples various system components including system memory 108 to processing unit 136. System bus 140 may be any of several types of bus structures including a memory bus or memory controller, a peripheral bus, and a local bus using any of a variety of bus architectures. System memory 108 includes read only memory ("ROM") 109 and random access memory ("RAM") 111. A basic input/output system ("BIOS") 110, containing the basic routines that help to transfer information between elements within computer 102, such as during start-up, is stored in ROM 109. Computer 102 further includes a hard disk drive 132 for reading from and writing to a hard disk 130.

Hard disk drive 132 is connected to system bus 140 by a hard disk drive interface 134. The drives and their associated computer-readable media provide nonvolatile storage of computer readable instructions, data structures, program modules and other data for computer 102. Although the exemplary environment described herein employs hard disk 130, it will be appreciated by those skilled in the art that other types of computer readable media which can store data that is accessible by computer 102, such as optical disk drives and disks, magnetic cassettes, flash memory cards, digital video disks, Bernoulli cartridges, random access memories, read only memories, and the like may also be used in the exemplary operating environment.

A number of program modules may be stored on hard disk 130, ROM 109, or RAM 111, including an operating system 114, one or more applications programs 116, printer program module 118, and program data 120. Hard disk 130 is shown to include a stored copy of program data 122, program modules 124 application programs 126 and operating system 128. A user may enter commands and information into computer 102 through input devices such as a keyboard 154 and a pointing device 152. Other input devices (not shown) may include a microphone, joystick, game pad, satellite dish, scanner, or the like. These and other input devices are often connected to processing unit 136 through an input/output ("I/O") unit 142 that is coupled to system bus 140, but may be connected by other interfaces, such as the parallel port (not shown), game port, or a universal serial bus ("USB"), for example. A monitor 104 or other type of display device is also connected to system bus 140 via an interface, such as a video adapter 138.

Computer 102 may operate in a networked environment using logical connections to one or more remote computers, such as a print server 148. Print server 148 may be another computer, a server, a router, a network computer, a peer device or other common network node, and typically includes many of the elements described above relative to the computer 102, although, often a print server 148 is dedicated to routing print requests from computer 102 to attached printers 150*a*-150*n* (collectively printers 150). Although, several printers 150 are shown, system for printing on lenticular sheets 100 may utilize one or more printers 150. Thus, in one aspect, system for printing on lenticular sheets 100 may not utilize print server 148, modem 144, and wide area network ("WAN") 143. Where these components are not used, computer 102 may be directly connected to one or more printers 150 via a direct connection. The logical connections depicted in FIG. 1 include a local area network ("LAN") 145 and WAN 143. Such networking environments are commonplace in offices, enterprise-wide computer networks, intranets and the Internet.

When used in a LAN networking environment, computer 102 is connected to LAN 145 through a network interface or adapter 146. When used in a WAN networking environment, computer 102 may include a modem 144 or other means for establishing communications over WAN 143. Modem 144, which may be internal or external, is connected to system bus 140 via the serial port interface (not shown). In a networked environment, program modules depicted relative to computer 102, or portions thereof, may be stored in the remote memory storage device. It will be appreciated that the network connections shown are exemplary and other means of establishing a communications link between the computers may be used.

In the description that follows, system for printing on lenticular sheets 100 will be described with reference to acts and symbolic representations of operations that are performed by one or more computers 102, unless indicated otherwise. As such, it will be understood that these acts and operations, which are at times referred to as being computer-executed, include the manipulation and transformation of particular articles, such as blank lenticular sheets to a different state or thing, such as printed lenticular sheets, by processing unit 136 of computer 102 of electrical signals representing data in a structured form, for example. This manipulation transforms the data or maintains it at locations in system memory 108 of computer 102, which reconfigures or otherwise alters the operation of computer 102 in a manner well understood by those skilled in the art. The data structures where data is maintained are physical locations of system memory 108 that have particular properties defined by the format of the data. However, while system for printing on lenticular sheets 100 is being described in the foregoing context, it is not meant to be limiting as those of skill in the art will appreciate that various of the acts and operations described hereinafter may also be implemented in hardware.

In accordance with one important aspect of the invention, computer 102 renders images locally using stored administrative settings synchronized with print server 148 and queues these images locally before forwarding them to print server 148 in an appropriate native printer language. In keeping with system 114 for printing on lenticular sheets 100, computer 102 may have the further ability to prepare images for printing on the lenticular sheets at one or more printers 150 while not logically connected to print server 148. Computer 102 may then poll print server 148 until it becomes available, at which time it may render the images and forward them for printing at printers 150 at that later time.

On computer 102, application programs 126 are shown running in the user-level, the level in which programs running on computer 102 interact with a computer user, for example. In other embodiments, there may be many applications running simultaneously on computer 102. In order to print on lenticular sheets at printers 150 connected locally or remotely to computer 102, most application programs 126 may not implement all of the required functionality themselves, but instead may rely on external modules. Nevertheless, in alternative embodiments, the printing subsystems may be part of application programs 126, part of operating system 128, or a separate program using underlying operating system functions.

Further, application programs 126 attempting to print on lenticular sheets may first communicate with modules (not shown) of operating system 128. In conjunction with application programs 126, these modules provide the functionality necessary to translate the application-specific image data into interphased images, and transfer the newly formatted interphased images to print server 148 and printers 150, for example. In another embodiment, application programs 126 may translate the interphased image data into the universal intermediate data format without the assistance of operating system 128. In yet another embodiment, application programs 126 may send the interphased image data to print server 148 and printers 150 ("print subsystem") along with some indication of which application program 126 has sent it, and the printing subsystem may translate the interphased image data into a native printer language for printing at printers 150. Alternatively, application programs 126 may implement the print subsystem itself and later directly translate the interphased data into native printer language. In another embodiment, such translations and communications to printers 150 are done without print server 148, as would be commonly known to those skilled in the art.

Figure 2A:
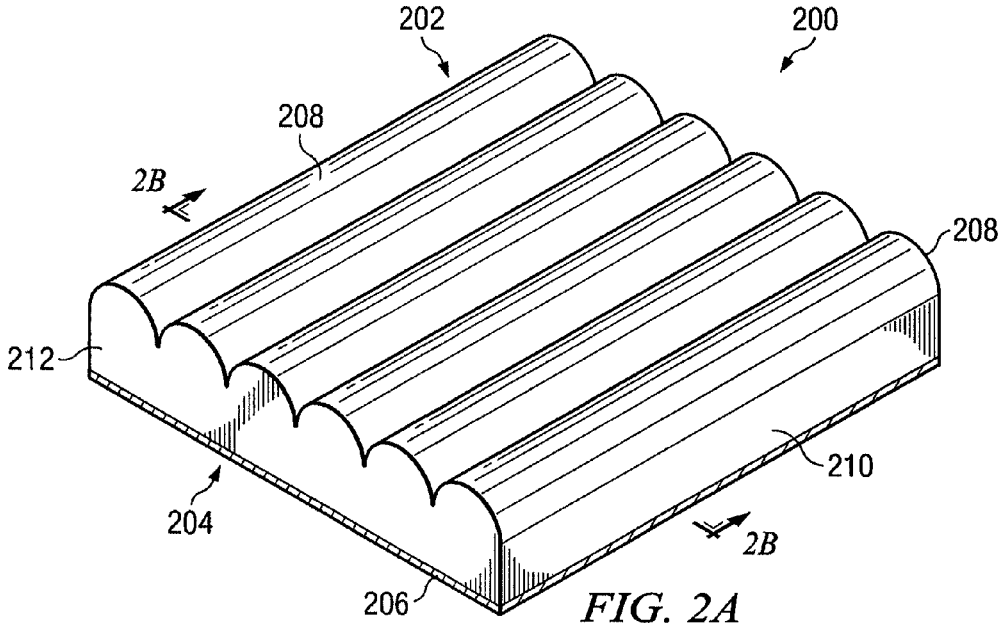
FIG. 2A is an illustration of a perspective view of a lenticular sheet according to one embodiment.
Figure 2B:
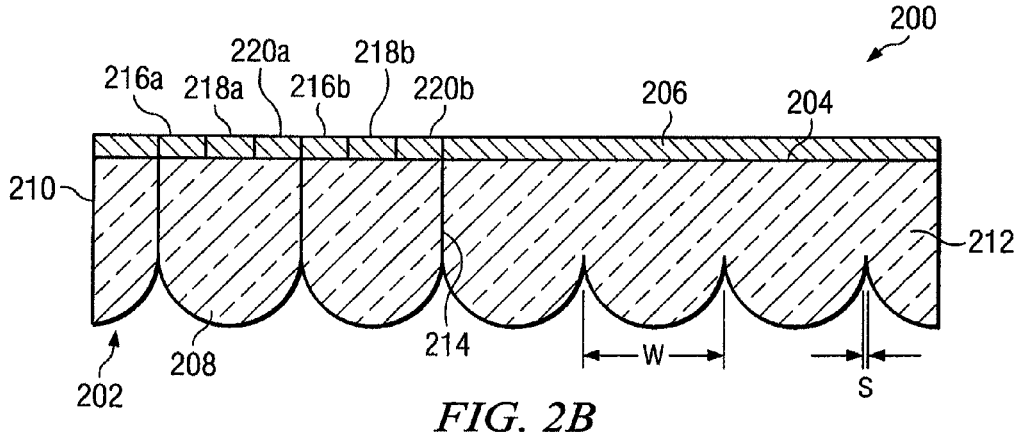
FIG. 2B is an illustration of a cross-section view of the lenticular sheet of FIG. 2A through the cutting plane line 2B-2B according to one embodiment.

Turning now to FIGS. 2*a*-2*b*, an embodiment of an exemplary lenticular sheet 200 is shown. Lenticular sheet 200 includes a front surface 202 and a back surface 204 that are substantially the outside planar boundaries or surfaces of lenticular sheet 200. In one embodiment, front surface 202 faces a user for viewing purposes and back surface 204 is adjacent to a graphical image 206 that is printed onto back surface 204 by printer 150. Lenticular sheet 200 is made up of a plurality of cylindrical lenticules 208 that extend outwardly from front surface 202 towards a viewer. Graphical image 206 is viewed through lenticular sheet 200 by the viewer.

Lenticular sheet 200 further includes longitudinal sides 210 that extends the length of lenticules 208 on opposing sides of lenticular sheet 200. Lenticular sheet 200 also includes lateral sides 212 that extend the length of the ends of lenticules 208 on opposing sides of lenticular sheet 200. A contact line 214 is formed at the junction of two lenticules 208 located adjacent to each other. Graphical image 206 may be one or more graphical images that are interphased and printed onto back surface 204 of lenticular sheet 200. Graphical image 206 may include a first image strip 216*a*, a second image strip 218*a*, and a third image strip 220*a*, all located under a particular lenticule 208. Graphical image 206 may also include a first image strip 216*b*, a second image strip 218*b*, and a third image strip 220*b*, all located under an adjacent lenticule 208. Similarly, the remaining or other lenticules 208 may have such image strips printed on the back surface 204 of lenticular sheet 200. Although, three image strips are shown disposed adjacent to back surface 204 of a particular lenticule 208, any number of image strips may be printed on back surface 204 of lenticular sheet 200.

Lenticular sheet 200 may be formed according to any known extrusion method. The width of lenticules 208 is labeled "W" and the spacing between lenticules 208 is labeled "S." In one embodiment, the width and spacing for a particular lenticular sheet 200 may be substantially uniform. In another embodiment, width and spacing for a particular lenticular sheet 200 may vary. As discussed further below, system for printing on lenticular sheets 100 determines the width and spacing for a particular lenticular sheet 200 inserted or disposed into one or more of printers 150 and communicates these dimensions to computer 102.

Figure 3:
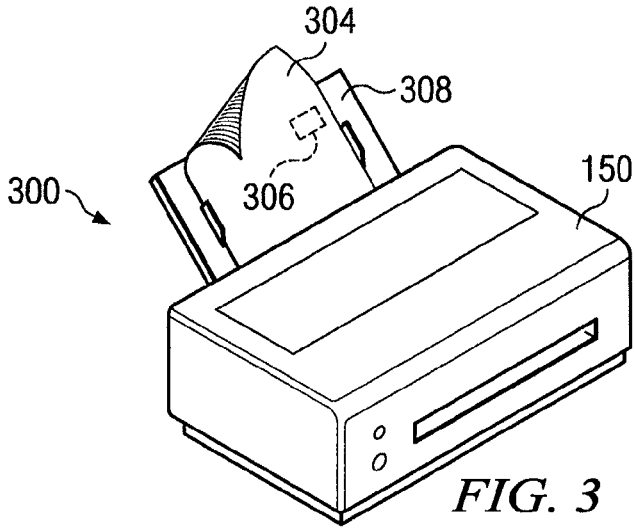
FIG. 3 is an illustration of a perspective view of a printer including a lenticular sheet and a lenticular sheet sensor according to one embodiment.

Referring now to FIG. 3, an embodiment 300 of a printer 150 containing a lenticular sheet 304 is shown. Printer 150 includes a lenticular sheet feed tray 308 for positioning or disposing lenticular sheet 304 prior to printing by printers 150. A lenticular sheet sensor 306 is disposed on the back side of lenticular sheet feed tray 308 for scanning or sensing the lenses per inch ("LPI"), edge, and alignment of lenticular sheet 304 when lenticular sheet 304 is placed in lenticular sheet feed tray 308. Although one lenticular sheet feed tray 308 is shown, printer 150 may have any number of lenticular sheet feed tray 308 according to system for printing on lenticular sheets 100.

Figure 4A:
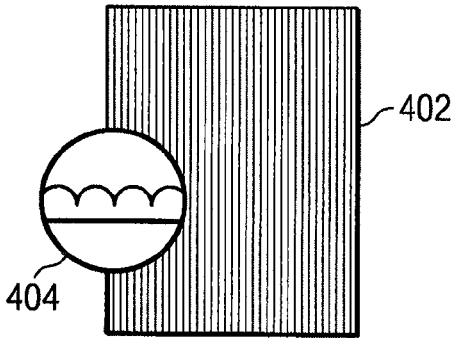
FIG. 4A is an illustration of a plan view and enlarged side view of a measurement of an aligned lenticular sheet by a lenticular sheet sensor according to one embodiment.
Figure 4B:
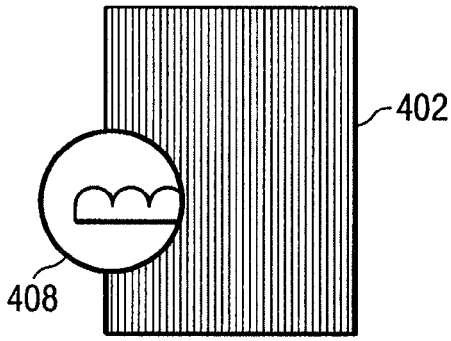
FIG. 4B is an illustration of a plan view and enlarged side view of a measurement of a misaligned lenticular sheet by a lenticular sheet sensor according to one embodiment.
Figure 4C:
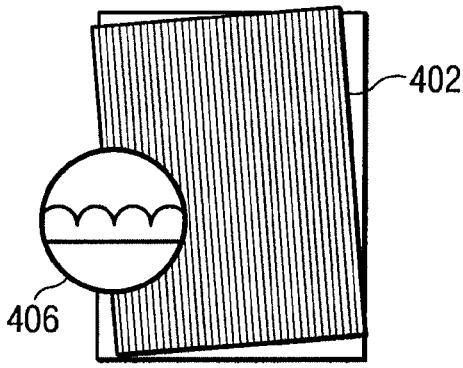
FIG. 4C is an illustration of a plan view and enlarged side view of a measurement of the edge of a lenticular sheet by a lenticular sheet sensor according to one embodiment.

Referring to FIGS. 4A-4C, a lenticular sheet 402 is shown with various dimensions being determined by lenticular sheet sensor 306. FIG. 4A depicts a determination of lenticular sheet 402 by lenticular sheet sensor 306 for the LPI as shown by the cross section of enlarged portion 404. FIG. 4B depicts a determination of lenticular sheet 402 by lenticular sheet sensor 306 for the edge or beginning of the first lenticule 208 of lenticular sheet 402 relative to a print head, a guide, or other assembly or mechanism of printer 150, as further described below. Additionally, FIG. 4C depicts a determination of lenticular sheet 402 by lenticular sheet sensor 306 for its alignment or misalignment relative to lenticular sheet feed tray 308 of printer 150, as further described below.

Figure 5:
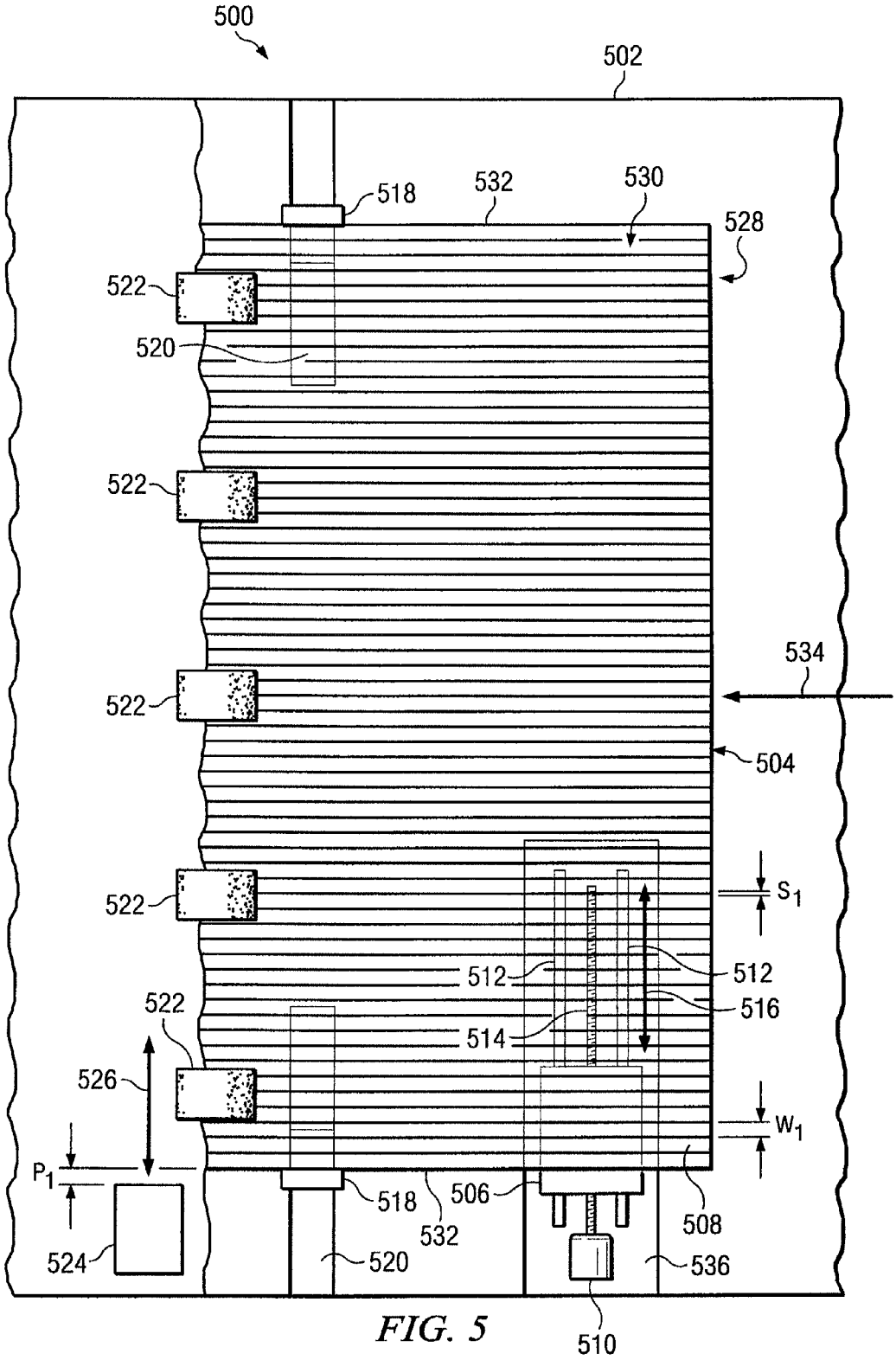
FIG. 5 is an illustration of a plan view of a printer having a lenticular sheet feed tray, lenticular sheet sensor in a first position, print head, and an aligned lenticular sheet with lenticules oriented longitudinally with the direction of travel of the lenticular sheet feed tray according to one embodiment.
Figure 6:
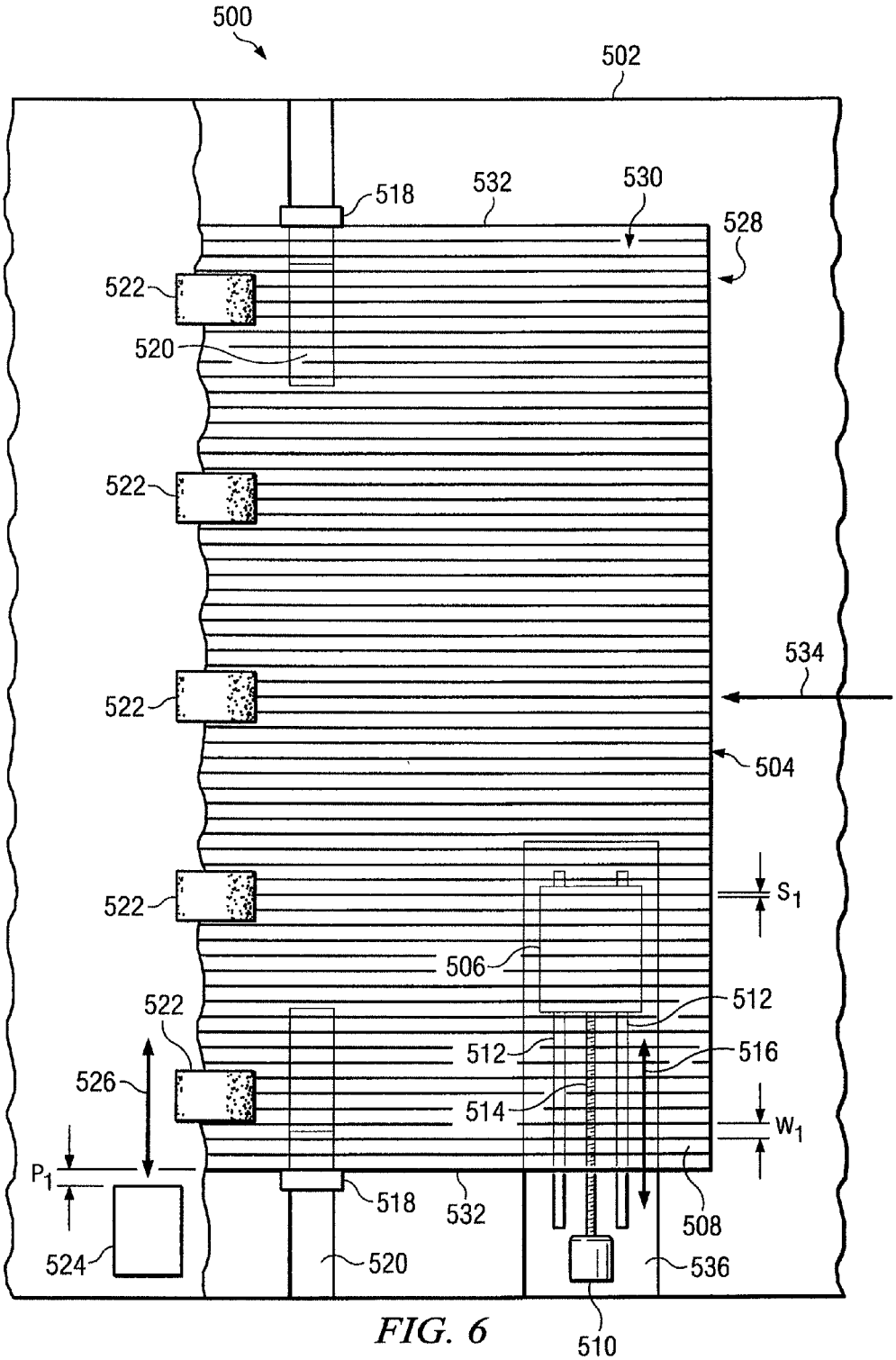
FIG. 6 is an illustration of a plan view of the printer of FIG. 5 having a lenticular sheet feed tray, lenticular sheet sensor in a second position, print head, and an aligned lenticular sheet with lenticules oriented longitudinally with the direction of travel of the lenticular sheet feed tray according to one embodiment.

Referring now to FIGS. 5-6, an embodiment of a printer 500 having a lenticular sheet feed tray 502 with a lenticular sheet 504 is shown. Lenticular sheet 504 is fed into lenticular sheet feed tray 502 by a user or other machinery, such as an automated feed mechanism, as is commonly understood by those skilled in the art. As described above, system for printing on lenticular sheets 100 determines several parameters of lenticular sheet 504 while it is being fed, positioned, or otherwise disposed in lenticular sheet feed tray 502 of printer 500. For purposes of describing the structure and operation of printer 500, mainly the portions relating to lenticular sheet feed tray 502 and lenticular sheet 504 are shown and described herein. As would be commonly understood by those skilled in the art, additional mechanisms relating to feeding lenticular sheet 504 through printer 500 also exist, such as rollers, feed mechanisms, and the like.

Lenticular sheet feed tray 502 may be a substantially flat or planar support that contains and holds lenticular sheet 504 prior and during feeding and printing of lenticular sheet 504 by printer 500. In one aspect, the back surface of lenticular sheet 504 is adjacent to lenticular sheet feed tray 502, such that a print head 524 of printer 500 having movement direction 526, may print an interphased graphical image on the back surface 528 of lenticular sheet 504. In this orientation, a front surface 530 of lenticular sheet 504 faces upwards away from the surface of lenticular sheet feed tray 502. Lenticular sheet 504 is fed into lenticular sheet feed tray 502 and held in position by one or more feed guides 518 that move laterally within guide channels 520. Feed guides 518 may be moved laterally inwardly and outwardly by a user or other mechanism to contain lenticular sheet 504 within lenticular sheet feed tray 502. As shown, the outward edges 532 of lenticular sheet 504 are substantially in contact with feed guides 518 for providing lateral support of lenticular sheet 504 during feeding through printer 500 by a drive mechanism, such as rollers 522. Preferably, rollers 522 provide a uniform passage of lenticular sheet 504 and/or lenticular sheet 804 through printer 500 and/or printer 800, respectively. Once the orientation of lenticules 208 has been sensed, then the uniform passage of lenticular sheet 504 and/or lenticular sheet 804 through printer 500 and/or printer 800, respectively, may be dependent upon accurately and precisely maintained pull mechanism associated with printer 500 and/or printer 800 and rollers 522. Proper rollers 522 configuration is critical along with mechanism such as springs, etc. to maintain the proper tension and orientation of lenticular sheet 504 and/or lenticular sheet 804 through printer 500 and/or printer 800, respectively.

Printer 500 further includes a lenticular sheet sensor 506 that moves laterally across lenticular sheet feed tray 502 under lenticular sheet 504 such that it measures, scans, or determines several parameters of lenticular sheet 504 prior to printing of back surface 528 of lenticular sheet 504 by print head 524. In another embodiment, the orientation of 505 and lenticular sheet sensor 506 may be reversed, such that lenticular sheet sensor 506 may move on top of lenticular sheet 504 when lenticular sheet 504 is reversed in position. Lenticular sheet sensor 506 moves laterally along one or more sensor tracks or guiding rods 512 in a direction shown as 516. A drive mechanism, such as driving screw 514 is operated by drive motor 510 such that driving screw 514 is turned and drives lenticular sheet sensor 506 back and forth laterally along direction 516. Any other types of drive mechanism or motors may be employed for moving lenticular sheet sensor 506 laterally relative to lenticular sheet 504. In one embodiment, lenticular sheet sensor 506, guiding rods 512, driving screw 514, and drive motor 510 are located on lenticular sheet feed tray 502 such that they may be flush with lenticular sheet feed tray 502 and do not impede the feeding of lenticular sheet 504 through printer 500. In one aspect, they may be located within a cavity 536, such as a depression, cutout, chamber, hollow, or notch of lenticular sheet feed tray 502. In one embodiment, lenticular sheet sensor 506 is a laterally reciprocating sensor that traverses or travels back and forth the width of lenticular sheet 504.

Lenticular sheet sensor 506 moves laterally or longitudinally relative to lenticular sheet feed tray 502 and lenticular sheet 504 such that it is capable of measuring, scanning, or determining several parameters of lenticular sheet 504 for use by system for printing on lenticular sheets 100 for determining accurately where to print ink dots on back surface 528 of lenticular sheet 504. For example, lenticular sheet sensor 506 of printer 500 may determine the width ("W.sub.1") of one or more lenticules 508 of lenticular sheet 504. This information is transmitted to computer 102 of system for printing on lenticular sheets 100 and used to determine the ink dot placements on back surface 528 of lenticular sheet 504 during printing by printer 500. As shown, FIG. 5 shows lenticular sheet sensor 506 in a first position relative to lenticular sheet 504 and FIG. 6 shows lenticular sheet sensor 506 in a second position relative to lenticular sheet 504 after it has moved or traversed across a portion of lenticular sheet 504. During this movement, lenticular sheet sensor 506 measures, scans, or determines the parameters of lenticular sheet 504 as described herein. Although, lenticular sheet sensor 506 is not shown traveling the entire length of lenticular sheet 504, in another embodiment, lenticular sheet sensor 506, guiding rods 512, driving screw 514, and drive motor 510 provide travel or movement of lenticular sheet sensor 506 across the entire width or lenticular sheet 504. Lenticular sheet sensor 506 may determine W.sub.1 by taking measurements of lenticular sheet 504 as it traverses across lenticular sheet feed tray 502 relative to lenticular sheet 504. In one aspect, lenticular sheet 504 may have lenticules 208 that are uniform in width, and in another aspect lenticular sheet 504 may have lenticules 208 that are varied in width. Lenticular sheet sensor 506 is capable of determine consistent or varied widths of lenticular sheet 504 and transmitting this information and data back to computer 102 or system for printing on lenticular sheets 100.

Additionally, lenticular sheet sensor 506 of printer 500 determines the spacing ("$S_1$") between one or more lenticules 208 of lenticular sheet 504 that may be uniform or varied across any particular lenticular sheet 504. Typically, $S_1$ exists between each of lenticules 208 of lenticular sheet 504. Similar to that described above, lenticular sheet sensor 506 traverses or travels laterally across lenticular sheet feed tray 502 and measures, scans, and/or determines $S_1$ between lenticules 208 for determining where to print ink dots on back surface 528 of lenticular sheet 504. This information or data is transmitted from printer 500 to computer 102 of system for printing on lenticular sheets 100 for processing and later instructing printer 500 where to print the ink dots on back surface 528 of lenticules 208 of lenticular sheet 504.

Figure 7:
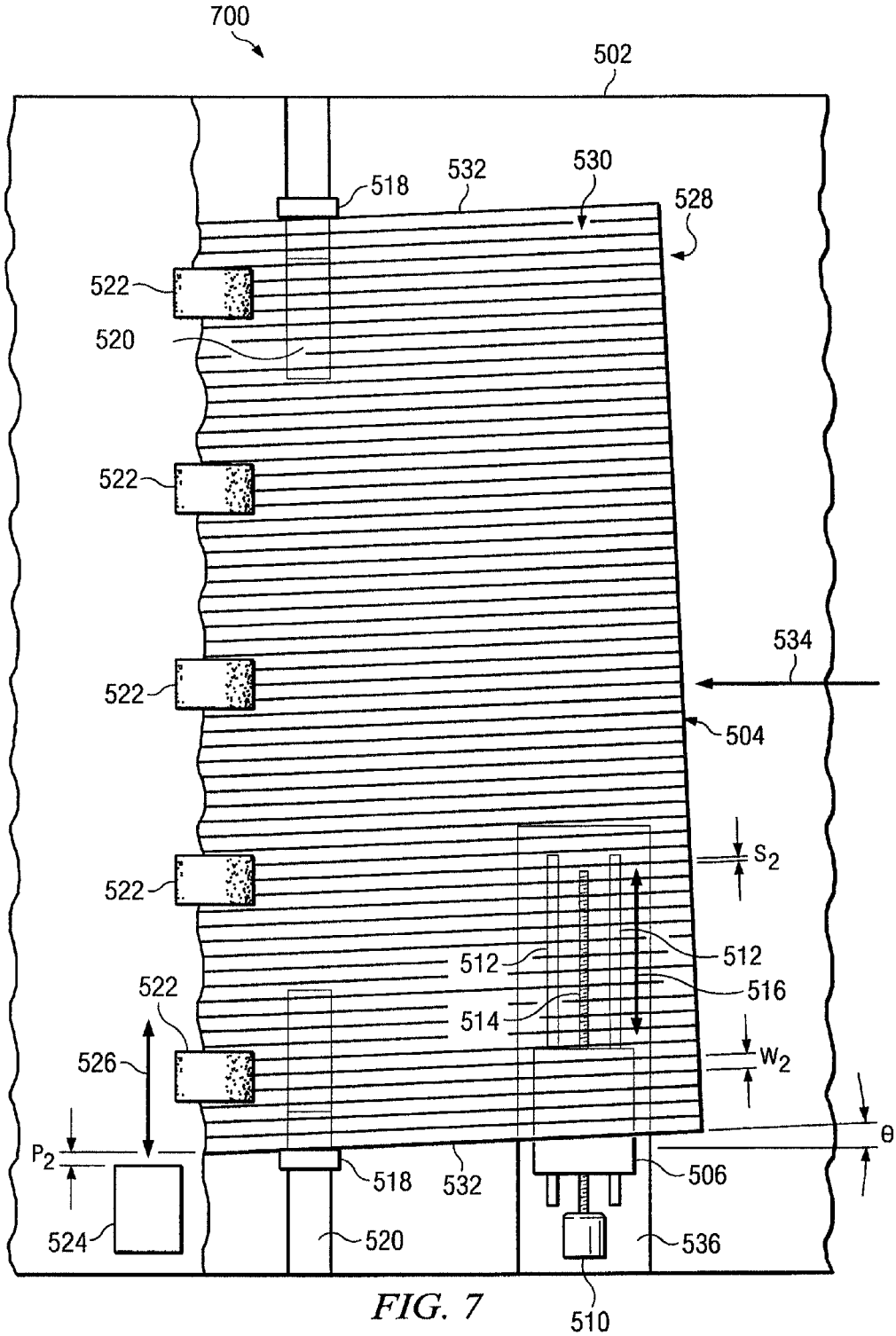
FIG. 7 is an illustration of a plan view of a printer having a lenticular sheet feed tray, lenticular sheet sensor in a first position, print head, and a misaligned lenticular sheet with lenticules oriented substantially longitudinally with the direction of travel of the lenticular sheet feed tray according to one embodiment.

Further, lenticular sheet sensor 506 of printer 500 determines the orientation or position ("$P_1$") of lenticular sheet 504 relative to one or more feed guides 518 or other reference points of printer 500 as now described with reference to FIG. 7. As described above, outward edges 532 of lenticular sheet 504 of FIGS. 5-6, show that they are substantially parallel or aligned with feed direction 534 and the edge of feed guides 518, thus $P_1$ in this example would be 0 degrees of offset. As shown, the longitudinal or main axis of lenticules 208 of lenticular sheet 504 are vertical or aligned or in the same direction of feed direction 534 of printer 500. In contrast, printer 700 is shown with lenticular sheet 504 misaligned with feed direction 534 of lenticular sheet feed tray 502 and feed guides 518. Lenticular sheet 504 is offset by a position $P_2$ of angular displacement measured as angle θ formed by outward edges 532 and feed guides 518 of printer 700. $P_2$ may be caused by the misplacement of lenticular sheet 504 on lenticular sheet feed tray 502 by a user or an automated feeding mechanism. In this example, lenticular sheet sensor 506 measures, scans, or determines $P_2$ prior to printing on back surface 528 of lenticular sheet 504 by print head 524 of printer 700.

In this embodiment, it can be seen that outward edges 532 are angled away from feed guides 518 creating an angular displacement θ. In another aspect, lenticular sheet sensor 506 may measure, scan, or determine the angular displacement θ between outward edges 532 and any other reference point on lenticular sheet feed tray 502 or printer 700. As described above, lenticular sheet sensor 506 may also determine the width ("$W_2$") and spacing ("$S_2$") of lenticular sheet 504 as it travels or moves laterally relative to lenticular sheet feed tray 502 and lenticular sheet 504.

Figure 8:
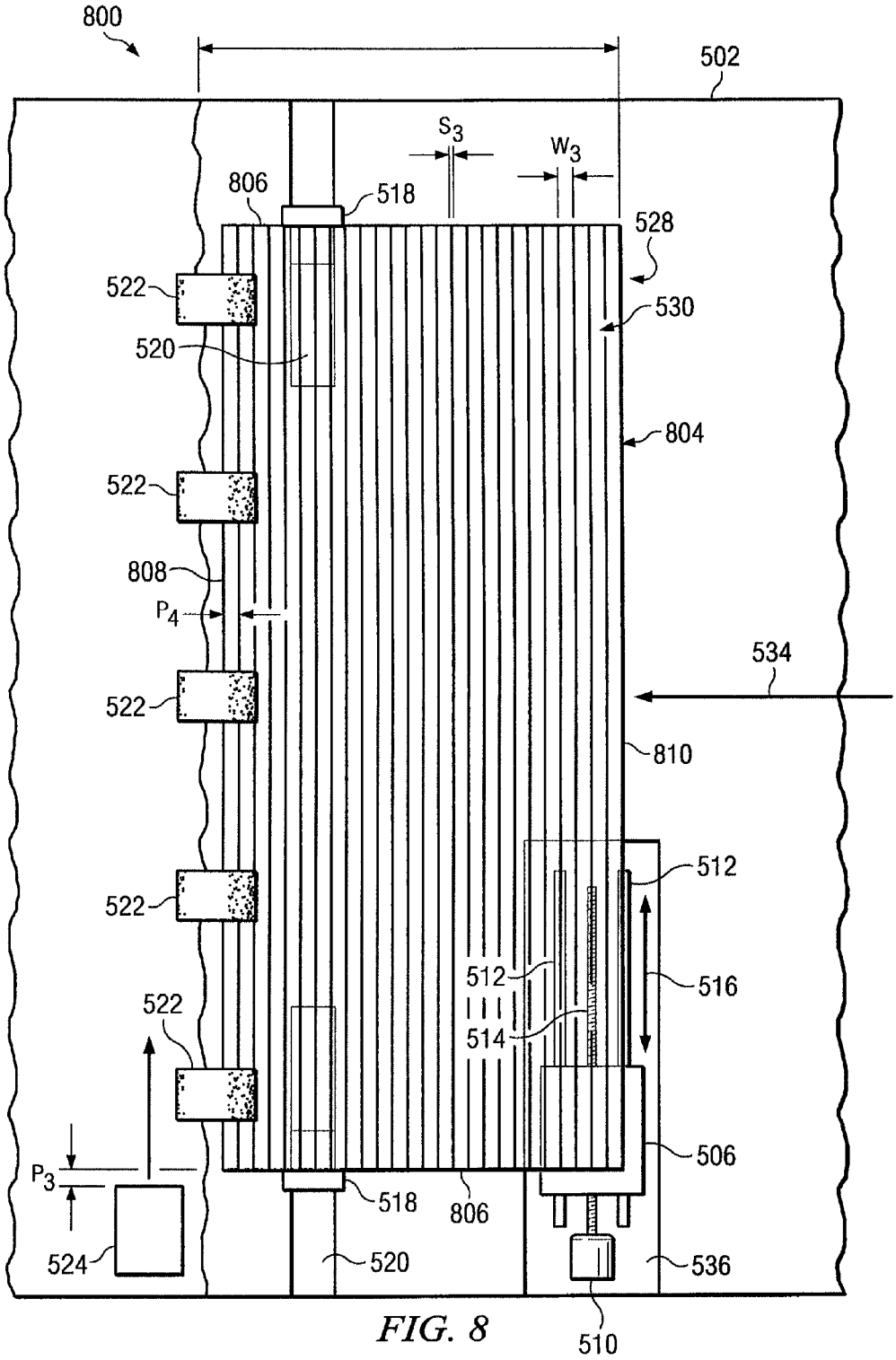
FIG. 8 is an illustration of a plan view of a printer having a lenticular sheet feed tray, lenticular sheet sensor in a first position, print head, and a lenticular sheet with lenticules oriented laterally with the direction of travel of the lenticular sheet feed tray according to one embodiment.

Referring now to FIG. 8, another embodiment of a printer 800 with a lenticular sheet 804 disposed or positioned in lenticular sheet feed tray 502 such that the lenticules 208 are aligned laterally or horizontally with feed direction 534. In this embodiment, as lenticular sheet 804 is fed into lenticular sheet feed tray 502, lenticular sheet sensor 506 may measure, scan, or determine the position ("$P_4$") of the first lenticule 208 relative to the a leading outward edge 808. Additionally, lenticular sheet sensor 506 may also determine a spacing ("$S_3$") and a width ("$W_3$") of some or all of lenticules 208 of lenticular sheet 804. Lenticular sheet sensor 506 may further determine a position ("$P_3$") of outward edges 806 for alignment as discussed herein.

Lenticular sheet sensor 506 may be any type of sensor or scanner that is capable of determining $W_1$, $W_2$, $W_3$, $S_1$, $S_2$, $S_3$, $P_1$, $P_2$, $P_3$, and $P_4$, of any particular lenticular sheet 504, 804 when it is disposed on lenticular sheet feed tray 502. Some exemplary lenticular sheet sensors 506 may include optical-electrical devices, scanners, ultrasonic devices, laser devices, and/or capacitance sensors. Preferably, lenticular sheet sensor 506 is capable of sensing the individual lenticules 208 to a tolerance or sensitivity of 0.1-0.9 LPI. More preferable, lenticular sheet sensor 506 is capable of sensing the individual lenticules 208 to a tolerance or sensitivity of 0.01-0.09 LPI. Most preferably, lenticular sheet sensor 506 is capable of sensing the individual lenticules 208 to a tolerance or sensitivity of 0.001-0.009 LPI. Lenticular sheet sensor 506 may have a light source that is preferably positioned at a distance of from about 1 to about 5 mm from the receiver phototransistor.

Preferably, printer 500 and/or printer 800 have a minimum print resolution of at least 600 dots per inch ("DPI"), and a volume of ink per drop no greater than 2 picoliters ("pl"), maximum. Also preferably, lenticular sheet 504 and/or lenticular sheet 804 have a density of lenticules 208 of from about 20 LPI to about printer 500 LPI. Further, lenticular sheet sensor 506 is preferably capable of detecting variation in lenticules 208 orientation of at least 0.01°.

Figure 9:
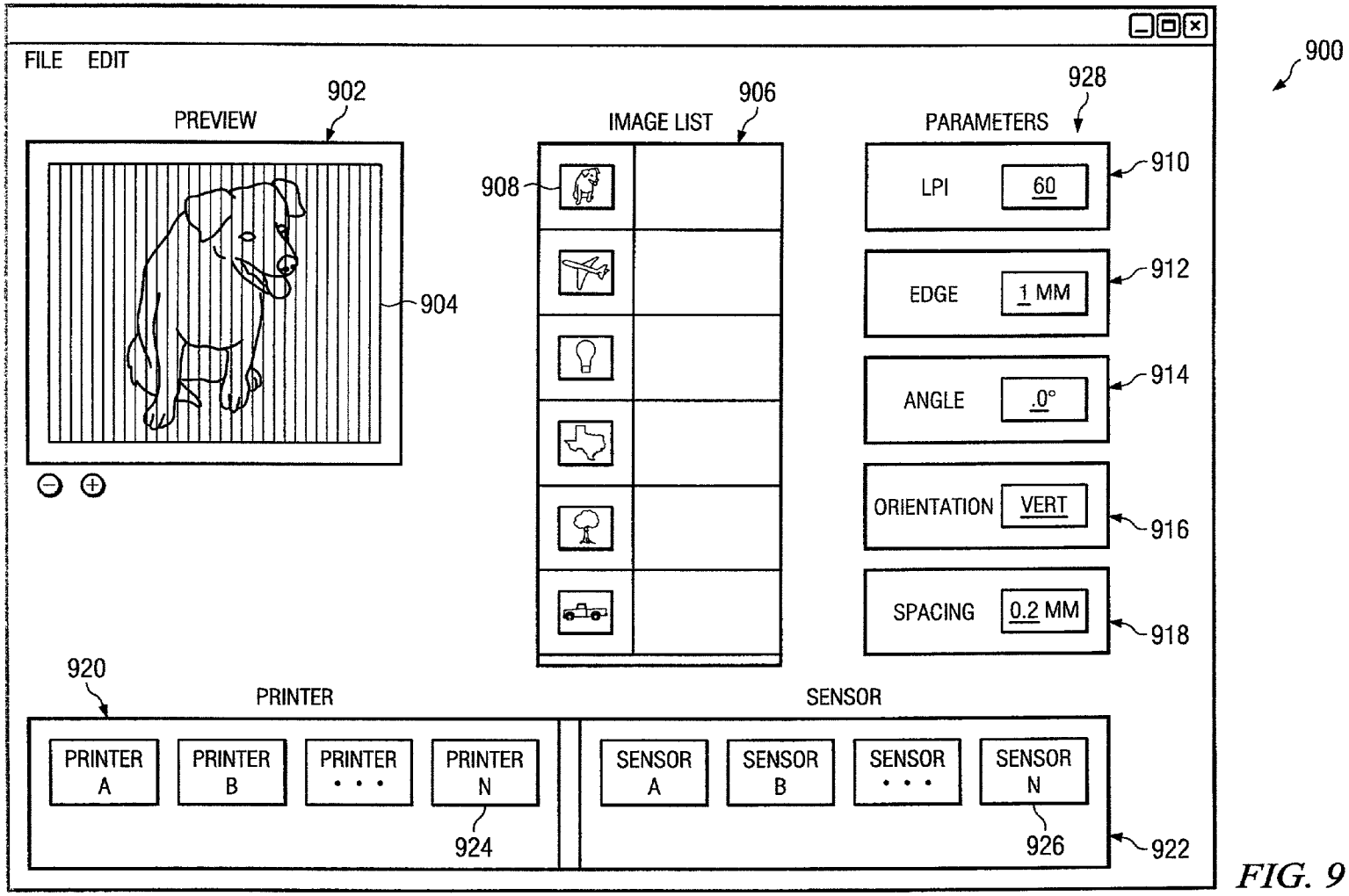
FIG. 9 is an illustration of a screen shot of an exemplary graphical user interface depicting a sensed longitudinally aligned lenticular sheet according to one embodiment.
Figure 10:
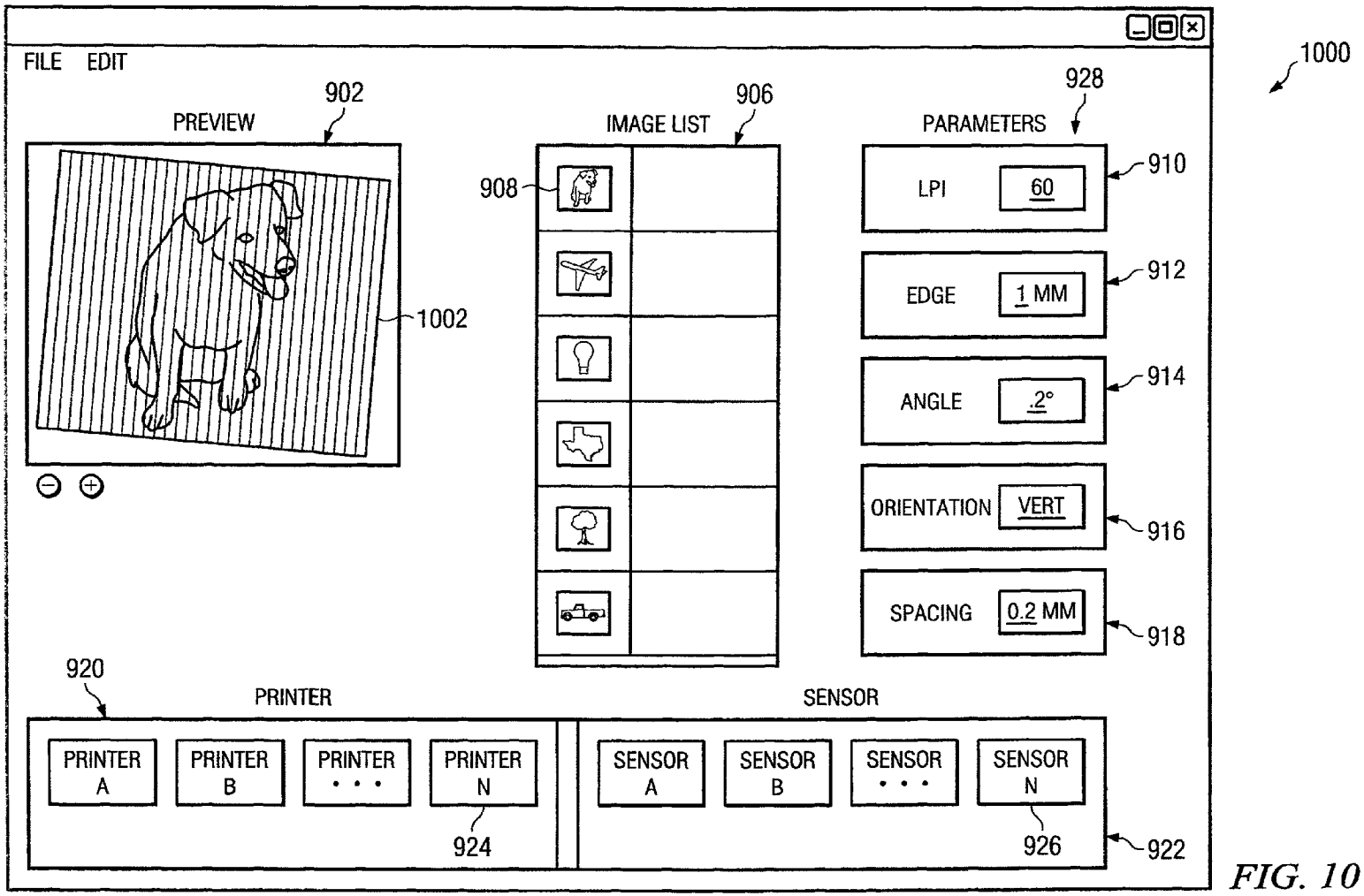
FIG. 10 is an illustration of a screen shot of an exemplary graphical user interface depicting a sensed misaligned lenticular sheet according to one embodiment.
Figure 11:
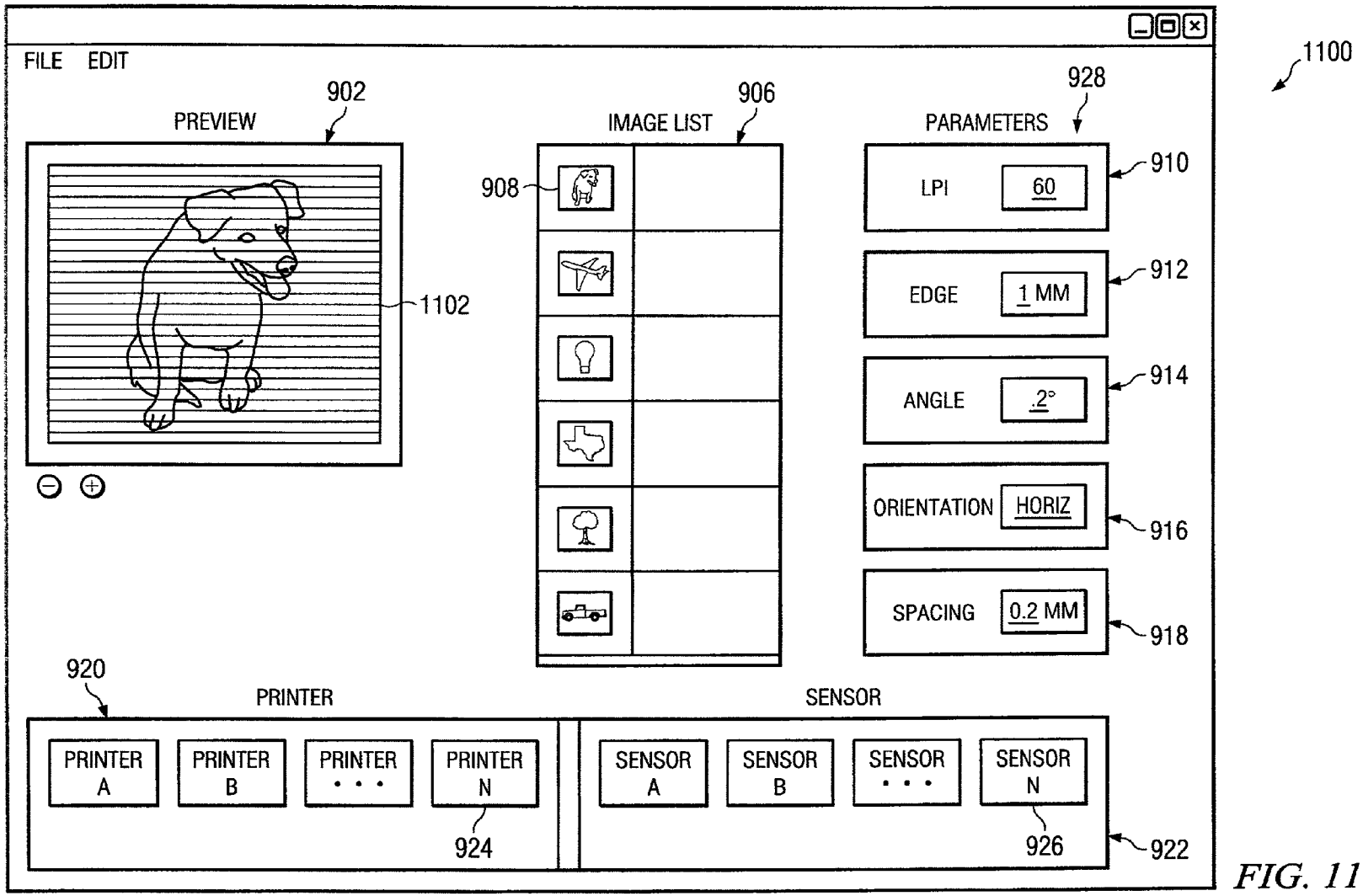
FIG. 11 is an illustration of a screen shot of an exemplary graphical user interface depicting a sensed laterally aligned lenticular sheet according to one embodiment.

Referring to FIGS. 9-11, embodiments of graphical user interfaces 900, 1000, and 1100 displaying information relating to particular measurements, scans, and/or determinations of lenticular sheet 504 and lenticular sheet 804 are shown. Generally, graphical user interfaces 900, 1000, and 1100 are displayed on monitor 104 to a user, for example. Graphical user interfaces 900, 1000, and 1100 may include a number of display and input fields are displayed to a user of graphical user interfaces 900, 1000, and 1100. Graphical user interfaces 900, 1000, and 1100 may include a preview field 902, a displayed image 904, an image list 906, a plurality of graphical images 908, a LPI field 910, an edge field 912, an angular displacement field 914, an orientation field 916, a spacing field 918, a printer list 920, a sensor list 922, a printer 924, a sensor 926, and a list of parameters 928. Graphical images 908 may be one or more: (a) temporal graphical images displaying a time sequence; (b) spectral graphical images recorded using sensors that respond to different wavelength; and/or (c) spatial graphical true stereoscopic images with full depth of field.

FIGS. 9-10 show preview field 902 with displayed image 904 and displayed image 1002 of a particular lenticular sheet 504 that has been fed into printer 500 of system for printing on lenticular sheets 100. FIG. 11 shows preview field 902 with displayed image 1102 of a particular lenticular sheet 804 that has been fed into printer 800 of system for printing on lenticular sheets 100. Preview field 902 may also include one or more graphical images 908 that may be selected from image list 906. In one aspect, displayed image 904 may be displayed in preview field 902 showing lenticules 208 and graphical images 908 imposed on the back surface 528 of lenticular sheets 504, 804, for example. Image list 906 contains graphical images 908 that are stored on system for printing on lenticular sheets 100 for use and selection by a user. For example, a user may select a particular graphical image 908 from image list 906 for printing on back surface 528 of lenticular sheet 504 and/or lenticular sheet 804. The selected graphical image 908 may then be displayed on back surface 528 of lenticular sheet 504 and/or lenticular sheet 804 in preview field 902 prior to being printed on the actual back surface 528 of lenticular sheet 504 and/or lenticular sheet 804 by printer 500 and/or printer 800. Additionally, preview field 902 displays the actual position of displayed image 904 and displayed image 1002 on lenticular sheet feed tray 502 of printer 500 and printer 800. System for printing on lenticular sheets 100 then uses this information to adjust the interphased graphical images 908 for accurate printing on back surface 528 of lenticular sheet 504 and lenticular sheet 804.

Parameters 928 includes LPI field 910, edge field 912, angular displacement field 914, orientation field 916, and spacing field 918 that may be measured, scanned, or determined by printer 500 and printer 800 as lenticular sheet 504 and lenticular sheet 804 are fed into or fed through these printers during operation of the printers. LPI field 910 includes the lenses per inch of a particular lenticular sheets 504, 804 ($W_1$, $W_2$, $W_3$), which may be calculated by the determined width of each lenticule 208, that is fed into or through printers 500, 800. This data may include LPI for lenticular sheet 504 and lenticular sheet 804 having uniform or non-uniform lenticules 208 across the lenticular sheets. For example, lenticular sheet sensor 506 having scanned or sensed lenticular sheets 504, 804 and determined that there are 60 LPI for lenticular sheets 504, 804; this data is transmitted or communicated to computer 102 of system for printing on lenticular sheets 100 for displaying in LPI field 910 on monitor 104. Additionally, this data is used by system for printing on lenticular sheets 100 for accurately interphasing graphical images 908 for printing on back surface 528 of lenticular sheets 504, 804.

Edge field 912 is the data field for the distance between outward edges 532, 806, 808, 810 and a reference point, ($P_1$, $P_2$, $P_3$, $P_4$), such as feed guides 518. Lenticular sheet sensor 506 determines this distance during its scan or measurement of lenticular sheets 504, 804. Angular displacement field 914 is the data field for the angular displacement between outward edges outward edges 532, 806 and a particular reference point, such as feed guides 518. Orientation field 916 is the data field for the orientation of lenticules 208 of lenticular sheets 504, 804 relative to feed direction 534 of lenticular sheet feed tray 502 of printers 500, 800. Spacing field 918 is the data field for the spacing between lenticules 208 of lenticular sheets 504, 804 ($S_1$, $S_2$, $S_3$). For example, lenticular sheet sensor 506 having scanned or sensed lenticular sheets 504, 804 and determined that there is 1 millimeter ("mm") from outward edges 532 to feed guides 518; 0° of angular displacement; vertical alignment of lenticules 208; and spacing between lenticules 208 of 0.2 mm; this data may be transmitted or communicated to computer 102 of system for printing on lenticular sheets 100 for displaying in LPI field 910, edge field 912, angular displacement field 914, orientation field 916, and spacing field 918, respectively, on monitor 104. Additionally, this data is used by system for printing on lenticular sheets 100 for accurately interphasing graphical images 908 for printing on back surface 528 of lenticular sheets 504, 804.

Printer list 920 may include a list of printers 924 used by system for printing on lenticular sheets 100 to calculate the ink spots placed on back surface 528 of lenticular sheets 504, 804. A user may select among printer list 920 for a particular printer 924 that is used for printing. An exemplary printer may be an inkjet printer, for example. Each printer 924 contains data or information relating to the particular print head 524 associated with that particular printer. For example, this information may include ink spot size, or dots per inch ("DPI") of a particular print head 524. Sensor list 922 contains a list of lenticular sheet sensors 506 that may be used on one or more printers 500, 800. System for printing on lenticular sheets 100 having the information related to a selected printer 924 and sensor 926 may then "register" each to the other in making an accurate determination for printing the interphased graphical images 908 on back surface 528 of lenticular sheets 504, 804. Final print may be produced (a) by lamination, involving a multi-step manual or semi-automatic process; and/or (b) by direct printing on lenticular sheet 504 and/or lenticular sheet 804. In the case of (b), the non optical free surface may be treated to ensure minimum ink spread and maximum color density. In one aspect, back surface 528 of lenticular sheet 504 and/or lenticular sheet 804 has a special clear opaque coating, which is receptive to specially formulated inks to provide: (a) low ink spread; (b) high color intensity; and (c) high resolution printing.

Figure 12:
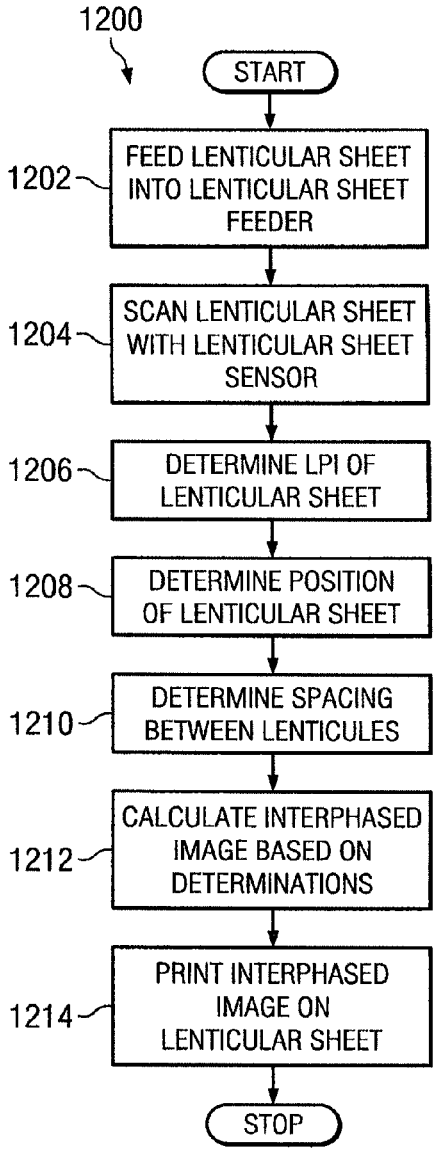
FIG. 12 is a flow diagram of an exemplary process for determining the number of lenticules of a lenticular sheet, the edge of the lenticular sheet, and the alignment of the lenticular sheet according to one embodiment.

Referring now to FIG. 12, a method for printing on lenticular sheets 1200 is described. In step 1202, lenticular sheet 504 and/or lenticular sheet 804 is fed into printer 500 and/or printer 800 having a print head 524 that is movable along lenticular sheet feed tray 502. Lenticular sheet feed tray 502 has a lenticular sheet sensor 506 that is mounted substantially flush to lenticular sheet feed tray 502. In step 1204, lenticular sheet sensor 506 moves, traverses, or travels across the width of lenticular sheet 504 and/or lenticular sheet 804.

In step 1206, lenticular sheet sensor 506 begins scanning or determining LPI of lenticular sheet 504 and/or lenticular sheet 804 at a scan rate a distance substantially lateral to feed direction 534 sufficient to cross a plurality of lenticules 208. In one embodiment, as lenticular sheet sensor 506 moves it generates a sensor data which is received by computer 102 of system for printing on lenticular sheets 100. As known to those of ordinary skill in the art of digital signal processing, the digital sample output rate (not labeled), in samples-per-second, of lenticular sheet sensor 506 is preferably at least ((2/W)*SCAN), where SCAN is in units of distance-per-second and W is in the same units of distance. In this step, computer 102 calculates the width W ($W_1$, $W_2$, $W_3$), or its inverse in terms of a spatial frequency of lenses-per-inch, for lenticules 208 per inch, based on the data generated by lenticular sheet sensor 506 during a scan.

In step 1208, computer 102 may also calculate position P ($P_1$, $P_2$, $P_3$, $P_4$) and angular displacement θ, which is from print head 524 to the left-most lenticule 208 of lenticular sheet 504 and/or ends of lenticules 208 of lenticular sheet 804. In step 1210, computer 102 may also calculate the spacing ($S_1$, $S_2$, $S_3$) between lenticules 208 of lenticular sheet 504 and/or lenticular sheet 804. In step 1212, these calculations may be based on an amplitude modulation, or amplitude notches, exhibited by the output of lenticular sheet sensor 506 as it moves in the lateral direction across lenticular sheet feed tray 502 and lenticular sheet 504 and/or lenticular sheet 804. The modulation or notches exhibited by lenticular sheet sensor 506 signal are due to the periodic fluctuation in the thickness of the optical path length (not labeled) through lenticules 208 of lenticular sheet 504 and/or lenticular sheet 804 to lenticular sheet sensor 506. The calculation of W may use a Fourier transform, or the autocorrelation of a signal from lenticular sheet sensor 506, or any other of the methods known to persons skilled in the art for estimating spacing or spatial frequency. Although steps 1206, 1208, and 1210 are shown in a temporal or sequential manner, these steps may be performed in a different order according to another embodiment of system for printing on lenticular sheets 100.

After calculating parameters 928 of lenticules 208 of lenticular sheet 504 and/or lenticular sheet 804, computer 102 raster image processes ("rips") and interphases a selected graphical image 908 representing the graphical image to be printed on back surface 528 of lenticular sheet 504 and/or lenticular sheet 804 and establishes, or modifies the pixel spacing to match parameters 928. In one aspect, the entire selected graphical image 908 is ripped, meaning that spacing for all of the pixels is determined based on one or more scans or determinations across lenticular sheet 504 and/or lenticular sheet 804. In step, interphased graphical image 908 is transferred to printer 500 and/or lenticular sheet 804 and printed on back surface 528 of lenticular sheet 504 and/or lenticular sheet 804. Preferably, the reading or determination of the first lenticule 208 of either lenticular sheet 504 or lenticular sheet 804 is used to set print head 524 to the point to start printing such that the ink dots will be placed appropriately behind the lenticular pattern of lenticular sheet 504 and/or lenticular sheet 804.

Figure 13:
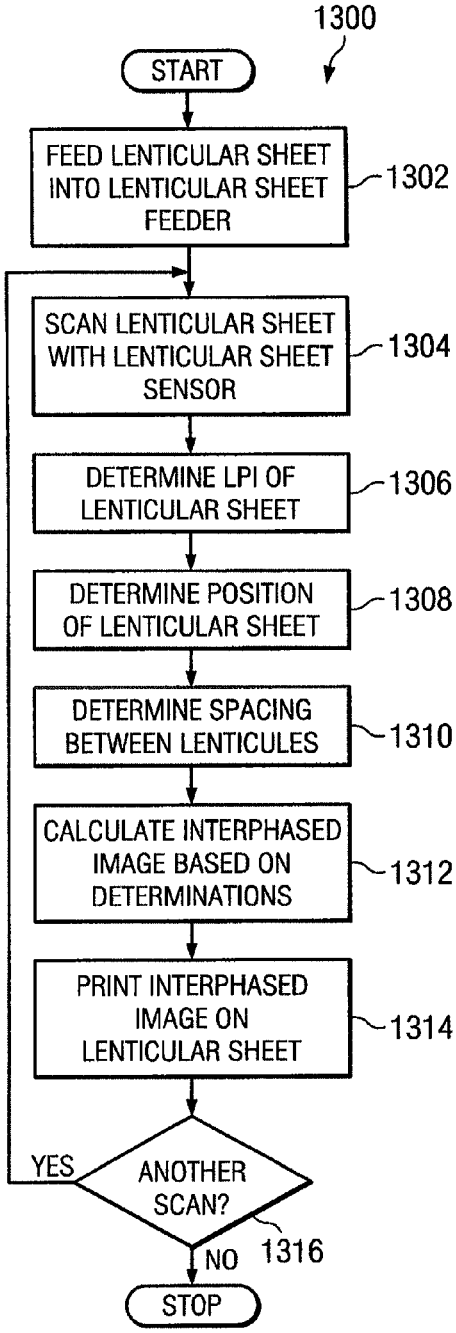
FIG. 13 is a flow diagram of another exemplary process for determining the number of lenticules of a lenticular sheet, the edge of the lenticular sheet, and the alignment of the lenticular sheet according to one embodiment.

Referring to FIG. 13, another embodiment of a method for printing on lenticular sheets 1300 is described. In this embodiment, critical to the achievement for high quality prints on lenticular sheet 504 and/or lenticular sheet 804 is the ability to position ink dots from printer 500 and/or printer 800 accurately behind specific sections of lenticules 208. Thus, the position of lenticules 208 must be read continuously as lenticular sheet 504 and/or lenticular sheet 804 is transported by rollers 522 and a feedback loop of system for printing on lenticular sheets 100 controls the positioning of the ink dots by print head 524.

Generally, steps 1302-1314 correspond to steps 1202-1214 as described above, respectively. In step 1316, computer 102 queries whether additional measurements, scans, and/or determinations are needed or requested during the feeding of lenticular sheet 504 and/or lenticular sheet 804 through printer 500 and/or printer 800, respectively. In this embodiment, the scanning and pixel spacing, may be performed periodically during the printing process. In addition, during step 1314, one or more lines of pixels may be printed across back surface 528 of lenticular sheet 504 and/or lenticular sheet 804 prior to another scan being performed in steps 1304-1312. Instead of the entire set of pixels for one or more interphased graphical images 908 being spaced in accordance with the first scan of lenticular sheet sensor 506, only a subset of the pixel rows are ripped, or spaced, formatted, and then printed for each scan. For example, after the first scan one or more of parameters 928 may be calculated for one row of each of interphased graphical images 908 that are to be printed. The row is printed and then steps 1304-1314 are repeated, a new set of parameters 928 are calculated, and another pixel row is ripped. The process repeats until the entire interphased graphical image 908 is printed. A variation of this embodiment prints a number (not labeled) of rows such as, for example, four, based on each scan. The specific number would be readily identifiable by one of ordinary skill, based on the degree of misalignment and the acceptable image quality.

The previous detailed description is of a small number of embodiments for implementing the system for printing on lenticular sheets and is not intended to be limiting in scope. One of skill in this art will immediately envisage the methods and variations used to implement this invention in other areas than those described in detail. The following claims set forth a number of the embodiments of the system for printing on lenticular sheets disclosed with greater particularity.

What is claimed:

1. A system for printing on lenticular sheets, comprising:

a printer having a lenticular sheet feed tray for holding at least one lenticular sheet having a plurality of lenticules;

a laterally reciprocating lenticular sheet sensor flushly disposed on the lenticular sheet feed tray for sensing parameters of the plurality of lenticules;

a computing system in communication with the printer and the laterally reciprocating lenticular sheet sensor and configured to execute software modules for adapting an interphased graphical image to the parameters and printing the adapted interphased graphical image on the at least one lenticular sheet.

2. The system for printing on lenticular sheets according to claim 1, wherein the parameters are selected from the group consisting of lenses per inch, width of the plurality of lenticules, spacing of the plurality of lenticules, position of the first of the plurality of lenticules closest to a print head of the printer, and angular displacement of the lenticular sheet relative to a reference point on the printer.

3. The system for printing on lenticular sheets according to claim 1, wherein the printer has a sensitivity of from about 0.001 to about 0.009 lenses per inch.

4. The system for printing on lenticular sheets according to claim 1, wherein the printer has a minimum print resolution of 600 dots per inch.

5. The system for printing on lenticular sheets according to claim 1, wherein the printer has a volume per ink drop of no greater than 2 picoliters.

6. The system for printing on lenticular sheets according to claim 1, wherein the computing system further comprises:

a display in communication with the computing system for displaying to a user one or more of the parameters and the adapted interphased graphical image.

7. The system for printing on lenticular sheets according to claim 1, wherein the laterally reciprocating lenticular sheet sensor further comprises:

a carrier for moving the lenticular sheet sensor reciprocally laterally across the at least one lenticular sheet.

8. The system for printing on lenticular sheets according to claim 1, further comprising:

at least two printers and their associated print heads; and at least two lenticular sheet sensors for registering the parameters of a selected one of the at least two printers to one of a selected at least two lenticular sheet sensors.

9. A method for printing on lenticular sheets, comprising:

disposing at least one lenticular sheet having a plurality of lenticules onto a lenticular sheet feed tray of a printer having a print head, the lenticular sheet feed tray having a reciprocating lenticular sheet sensor;

scanning the lenticular sheet with the reciprocating lenticular sheet sensor to determine parameters of the plurality of lenticules;

selecting a graphical image;

interphasing the graphical image;

adapting the interphased graphical image to substantially match the parameters; and printing the adapted interphased graphical image to the lenticular sheet.

10. The method for printing on lenticular sheets according to claim 9, further comprising:

displaying the adapted interphased graphical image.

11. The method for printing on lenticular sheets according to claim 9, wherein the parameters are selected from the group consisting of lenses per inch, width of the plurality of lenticules, spacing of the plurality of lenticules, position of the first of the plurality of lenticules closest to a print head of the printer, and angular displacement of the lenticular sheet relative to a reference point on the printer.

12. The method for printing on lenticular sheets according to claim 9, wherein the scanning of the lenticular sheet with the reciprocating lenticular sheet sensor further comprises:

determining the distance between a first edge of a first of the plurality of lenticules and the print head of the printer with the reciprocating lenticular sheet sensor.

13. The method for printing on lenticular sheets according to claim 9, wherein the scanning of the lenticular sheet with the reciprocating lenticular sheet sensor further comprises:

determining the angular displacement between a first edge of the first of the plurality of lenticules and the print head of the printer with the reciprocating lenticular sheet sensor.

14. The method for printing on lenticular sheets according to claim 9, wherein the scanning of the lenticular sheet with the reciprocating lenticular sheet sensor further comprises:

determining the spacing between the plurality of lenticules with the reciprocating lenticular sheet sensor.

15. The method for printing on lenticular sheets according to claim 9, wherein the scanning of the lenticular sheet with the reciprocating lenticular sheet sensor further comprises:

determining the lenses per inch of the plurality of lenticules with the reciprocating lenticular sheet sensor.

16. The method for printing on lenticular sheets according to claim 9, wherein the selecting of a graphical image further comprises:

displaying a plurality of graphical images to a user for selection by the user.

17. The method for printing on lenticular sheets according to claim 9, further comprising:

registering a selected printer and associated print head with a selected lenticular sheet.

18. An electronic system for printing on a lenticular sheet having a plurality of lenticules comprising:

an electronic input device for producing input signals;

a display;

a printer having a lenticular sheet feed tray for holding the lenticular sheet, the lenticular sheet feed tray having a reciprocating lenticular sheet sensor, the printer having a print head for printing ink dots on the lenticular sheet;

an electronic memory storing a list of graphical images; and an electronic processor communicating with the memory and the display and responsive to the input signals to:

determine parameters of the plurality of lenticules by the reciprocating lenticular sheet sensor;

accept a selection of one of the graphical images by the electronic input device;

interphase the selected graphical image based on the scanned parameters of the plurality of lenticules;

adapt the interphased graphical image to the graphical image based on the scanned parameters of the plurality of lenticules; and instruct the printer to print on the lenticular sheet the adapted interphased graphical image.

19. The system as in claim 18 wherein the electronic processor is further responsive to the input signals to:

record the distance between the first edge of a first of the plurality of lenticules and the print head of the printer with the reciprocating lenticular sheet sensor; and responsive to the recording, adapt the interphased selected graphical image with the recorded distance.

20. The system as in claim 19 wherein the electronic processor is further responsive to the input signals to:

record the angular displacement between the first edge of a first of the plurality of lenticules and the print head of the printer with the reciprocating lenticular sheet sensor; and responsive to the recording, adapt the interphased selected graphical image with the recorded angular displacement.

21. The system as in claim 19 wherein the electronic processor is further responsive to the input signals to:

record the spacing between the plurality of lenticules with the reciprocating lenticular sheet sensor; and responsive to the recording, adapt the interphased selected graphical image with the recorded spacing.

22. The system as in claim 19 wherein the electronic processor is further responsive to the input signals to:

record the lenses per inch of the plurality of lenticules with the reciprocating lenticular sheet sensor; and responsive to the recording, adapt the interphased selected graphical image with the recorded lenses per inch.

23. The system as in claim 19 wherein the electronic processor is further responsive to the input signals to:

select one of a plurality of printers, each with a stored parameters and select one of a plurality of lenticular sheets, each with a stored parameter, for registering the two parameters prior to printing.

* * * * *